US005265924A

United States Patent [19]

Kim

[11] Patent Number: 5,265,924

[45] Date of Patent: Nov. 30, 1993

[54] LEVER ASSEMBLY FOR A DOOR LOCK

[75] Inventor: Won S. Kim, Taegu, Rep. of Korea

[73] Assignee: Hyundai Metal Co., Ltd., Rep. of Korea

[21] Appl. No.: 996,208

[22] Filed: Dec. 23, 1992

[30] Foreign Application Priority Data

Apr. 20, 1992 [KR] Rep. of Korea ..... 92-6696

[51] Int. Cl.[5] ..... E05B 3/00

[52] U.S. Cl. ..... 292/336.3; 292/347; 292/357

[58] Field of Search ..... 292/347, 357, 336.3, 292/169.23, 173

[56] References Cited

U.S. PATENT DOCUMENTS 4,569,547 2/1986 Fayerman et al. ..... 292/347
4,998,760 3/1991 Nixon ..... 292/347
5,067,758 11/1991 Fann et al. ..... 292/347

*Primary Examiner*—Richard E. Moore
*Attorney, Agent, or Firm*—Morgan & Finnegan

[57] ABSTRACT

The lever assembly for a door lock comprises a door lock cylinder having a shank extended from each side of the door lock cylinder and two structure provided between the inside and outside lever and a door lock cylinder, respectively for resiliently returning and maintaining the levers in their horizontal positions. The returning and maintaining structure includes a spacer, a nut for fastening the spacer against the door lock cylinder, a mounting member for mounting a rotatable member, and a spring member cooperating with the rotatable structure and a retainer for holding the spring member, and a lever having a shaft fitted to the shank. The parts of the lever assembly are in turn fitted onto the shank in a cooperating relationship, thereby to resiliently return and maintain the lever in its original, horizontal position without tilting by using of the lever.

3 Claims, 4 Drawing Sheets

LEVER ASSEMBLY FOR A DOOR LOCK

FIELD OF THE INVENTION

This invention relates to lever assembly for a door lock.

BACKGROUND OF THE INVENTION

The conventional lever assembly for a door lock includes a coiled spring (31) in a door lock cylinder, which cooperates with a ratch (32) by rotation of a lever between locking and open positions, However, the lever acts on the coiled spring which weaken the resilience of the coiled spring with the using of the lever assembly.

In addition, when the contacting parts of the lever assembly are worn down, the lever is not maintained in its horizontal locking position there by tilting.

Farthermore, the locking of the lever assembly becomes loosened so that a door is apt to be opened. Such tilting and loosening of the lever assembly spoils the beauty of door.

SUMMARY OF THE INVENTION

The object of this invention is to provide an improved lever assembly for a door lock removing the problems mentioned above.

It is another object of this invention to provide a lever assembly comprising means provided between a lever and a door lock cylinder for resiliently returning and maintaining a lever in its horizontal position.

With these and other objects in view, the manner in which the invention achieves its purpose will be appreciated from following description and the accompanying drawings, in which.

Figure 3B:
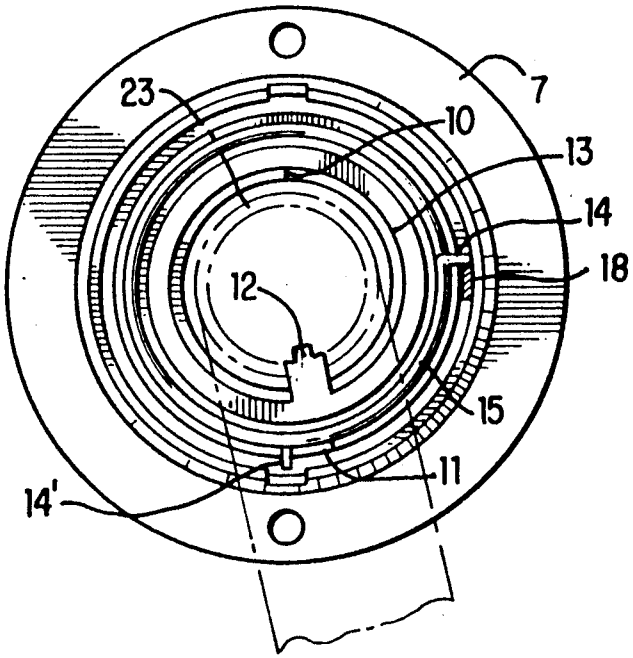
Figure 3A:
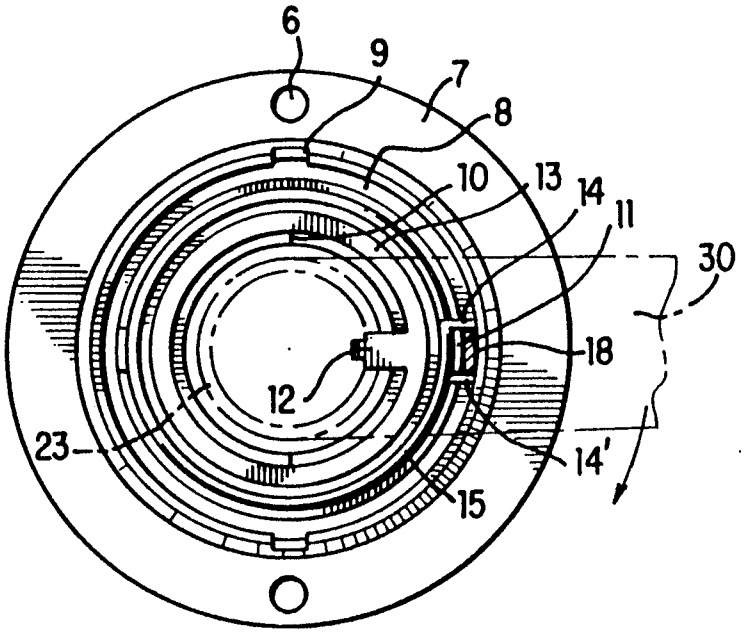
Figure 4B:
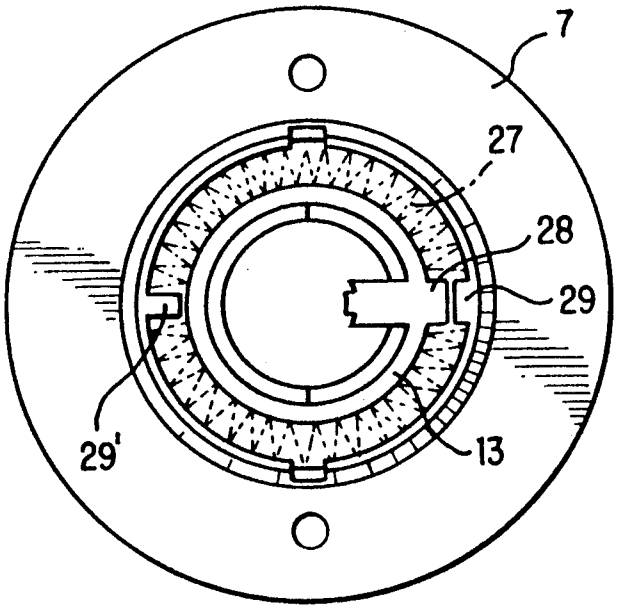
Figure 4A:
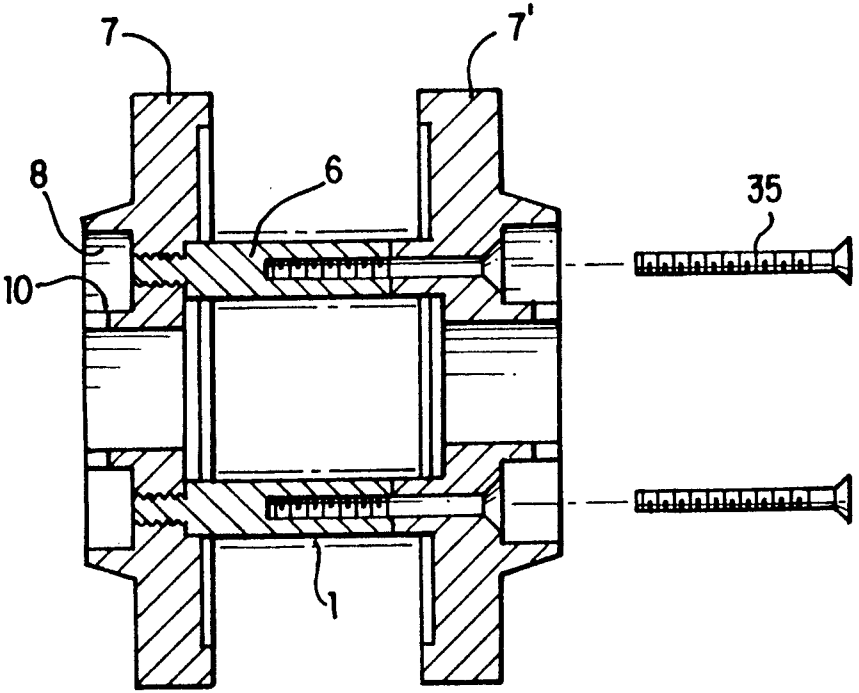

FIGS. 3*a* and 3*b* are the operational views of the means for resiliently returning and maintaining a lever in accordance with the invention;

FIGS. 4*a* and 4*b* show alternate constructions of the lever assembly of this invention.

Figure 1:
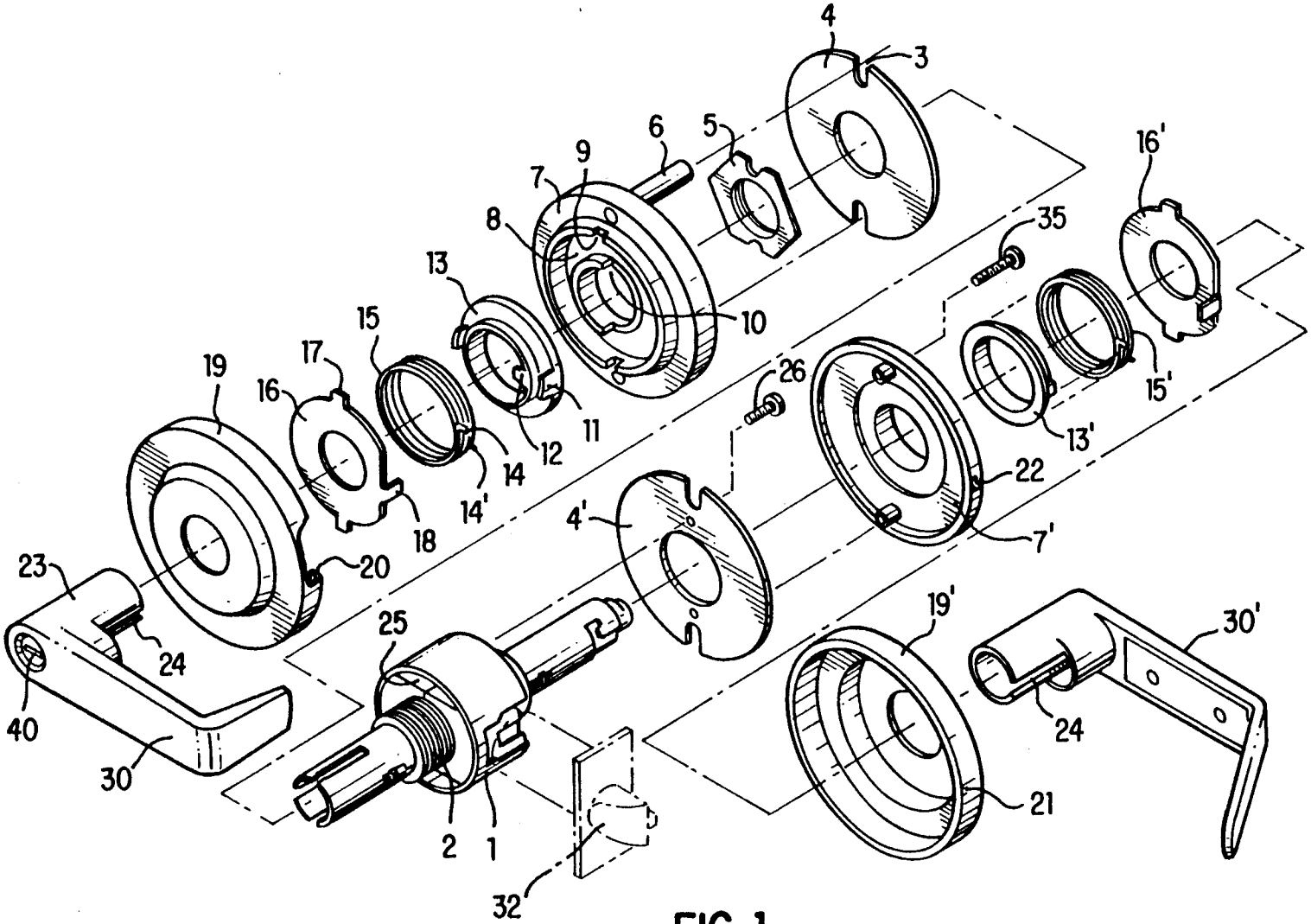
FIG. 1 is a exploded view of the lever assembly of this invention.
Figure 2:
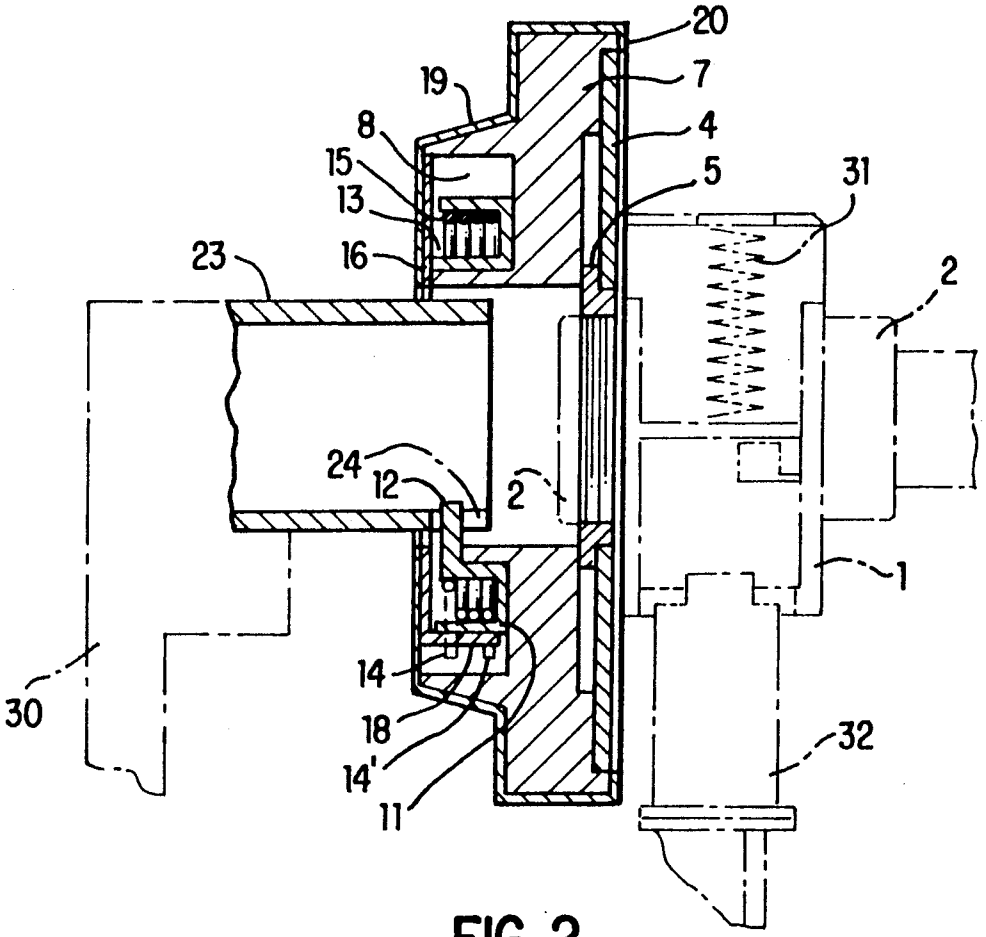
FIG. 2 is an elevational view in section of the lever assembly in FIG. 1.

Referring to FIGS. 1 and 2, a conventional door lock cylinder 1 has a shanl extended from each side thereof. A threaded portion 2 is formed at each of the inside and outside shank portions adjacent to the door lock cylinder 1. The threaded portion 2 of the outside shank portion is engaged which a nut 5 interposing a spacer 4 fitted onto the outside shank portion. The spacer 4 has two slots 3 at its periphery. A mounting member 7 having inwardly protruded studs 6 and 6' is then fitted onto outside shank portion with the studs 6 and 6' engaged with the corresponding slots 3 of the spacer 4. The nut 5 has two slots with the studs 6 and 6' pass through. The nut 5 may be adjustingly engaged with the threaded portion 2 according to the thickness of the door.

A ring-shaped, rotatable member 13 provided with two protrusions 11 paralled to the shank and a segment 12 radially protruded from the inner side thereof is mounted on a seat 8 formed at the mounting member 7. A spring member 15 is then mounted on the rotatable member 13.

Both ends 14 and 14' of the spring member 15 are outwardly bent to retain the protrusion 11 between them. A retainer 16 having two segments 17 oppositely formed at the periphery thereof is in turn mounted over the spring member 15.

Upon mounting of the retainer 16, the segments 17 are fitted into the corresponding slots 9 formed at the outside of the mounting member 7. The retainer 16 also has an inwardly extended segment 18 which is positioned between the ends 14 and 14' of the spring member 15.

A cover 19 is mounted on the door for covering the aforementioned assembly. A periphery portion 20 of the cover 19 is inwardly folded which does not allow to access to the inside of the cover 19.

On the inside shank portion of the door lock, the other spacer 4' is provided and secured to the cylinder by bolts 26.

A mounting member 7' is fitted onto the inside shank portion over the spacer 4' and is also secured to the outside mounting member 7 by means of an elongated bolt 35 which is threadedly engaged with the stud.

Then, a rotatable member 13, a spring member 15' and a retainer 16' are in turn mounted on the outside of the mounting member 7' in the same manner with the aforementioned mounting process of the corresponding members 13, 15 and 16 on the outside shank portion.

A cover 19' for covering the assembled members mentioned above has a protrusion 21 adapted to engage with a slot 22 formed at the mounting member 7' for locking together.

Then, shafts 23 and 23' of the outside and inside lever are fitted to the corresponding shank respectively. The shafts 23 and 23' has an elongated slots 24 and 24', respectively. The fittings of the shafts 23 and 23' are guided by the segments 12 and 12' of the rotatable members 13 and 13', the segments 12 and 12' being engaged with the corresponding elongated slots. The segments 12 and 12' each has a narrowed portion at the free end thereof.

Accordingly, the segments 12 and 12' act as a guide upon fitting of the shafts of the levers and to transmit the rotational torque of the lever to the shank of the door lock, respectively.

Numeral 40 indicates a conventional key cylinder, which is installed in the outside lever 30.

FIGS. 4*a* and 4*b* show alternate constructions. As in FIG. 4*a*, the studs 6 and 6' may be formed so that the studs 6 and 6' go through the internal space 25 defined by the door lock cylinder 1. The inner diameter portion of each of the studs 6 and 6' is threaded to receive the bolt 35' thereby allowing to easily assemble the inside and outside mounting members 7 and 7' together without the need of forming the threaded holes on the door for placing bolts.

Referring to FIG. 4*b*, a coiled spring 27 of the ring-shaped may be adopted instead of the coiled springs 15 seated in the mounting members 7 and 7'. In this construction, the rotatable members 13 include a protrusion 28 radially outwardly protruded therefrom, respectively and the mounting members 7 and 7' include two diametrically opposite lugs 29 and 29'.

The operation is as follows:

The lever 30 remains in a horizontal position when the door is closed. To open the door, the downward turning of the lever 30 by hand causes the segment 12 formed at the shaft 23 to rotate the rotatable member 13 thereby to wind the coiled spring 15 of which one bent end 14 is moved by the protrusion 11 of the rotatable member 13, whereas the other end 14' of the coiled spring 15 remains in its position by the segment 18 of the retainer 16. The segment 12 can rotate in the limited range by a stepped portion 10 formed at the mounting member 7.

When the lever 30 or 30' is released after opening or closing of the door, the returning force or the wound spring 15 causes the rotatable member 13 to rotate in its original, horizontal position thereby to return the lever 30 or 30'.

Accordingly, the lever 30 or 30' can be always resiliently returned in its original, horizontal position even long use thereof by adding means for resiliently returning and holding the lever.

It is further understood by those skilled in the art that the foregoing description is a preferred embodiment of the disclosed lever assembly and that various changes and modifications may be made in the invention without departing from the sprit and scope thereof.

What is claimed is:

1. A lever assembly for a door lock comprising a door lock cylinder;

a shank including an inside portion and an outside portion extended from each side of the door lock cylinder, said shank portions each having a thread portion adjacent to the door lock cylinder;

inside and outside spacers fitted onto the shank portion, having two slots respectively each;

a nut for fastening the outside spacer against the door lock cylinder;

inside and outside mounting members each including two studs for coupling together, two locking slots and a stepped portion;

inside and outside rotatable members each mounted on an outside of the respective mounting members, each having a radially protruded segment and two protrusions parallel to the shank;

inside and outside spring members mounted on the rotatable members, respectively, both ends of the each spring members being bent and engaged with two protrusions of the respective rotatable members;

inside and outside retainers each mounted over the respective spring members, having two protruded segments which are oppositely formed at the periphery thereof and an radially, inwardly extended segment, said two protruded segment being inserted into the corresponding slots of the respective mounting members, and said radial segment being positioned between the bent ends of the respective members;

inside and outside cover mounted on each side of the door for covering the assembled parts, said covers each having a periphery portion inwardly folded, said inside cover further having a protrusion to engage with a locking slot formed at the inside mounting member;

inside and outside lever each having a shaft in which an elongated slot is formed, said shaft being fitted to the corresponding shank such that the radial segment of the rotatable member is inserted into the elongated slot.

2. A lever assembly as claimed in claim 1, wherein said studs of the outside mounting member are extended through the internal space defined by the door lock cylinder, said inside and outside mounting members are coupled by an elongated bolt and an inner diameter portion of each stud of the outside mounting member is threaded to receive the elongated bolt.

3. A lever assembly as claimed in claim 1, wherein said spring members are coiled springs of the ring-shaped, said rotatable members each include a protrusion which is radially outwardly protruded from the outside diameter portion thereof, and said mounting members each include two diametrically opposite lugs for cooperating with the ring shaped spring.

* * * * *